US006660225B2

(12) United States Patent
Lim et al.

(10) Patent No.: US 6,660,225 B2
(45) Date of Patent: Dec. 9, 2003

(54) METHOD TO FORM MULTI-MATERIAL COMPONENTS

(75) Inventors: Kay Leong Lim, Singapore (SG); Lye-King Tan, Singapore (SG); Eng-Seng Tan, Singapore (SG); Robin Baumgartner, Singapore (SG)

(73) Assignee: Advanced Materials Technologies Pte, Ltd., Singapore (SG)

( * ) Notice: Subject to any disclaimer, the term of this patent is extended or adjusted under 35 U.S.C. 154(b) by 0 days.

(21) Appl. No.: 09/960,908

(22) Filed: Sep. 24, 2001

(65) Prior Publication Data

US 2002/0071781 A1 Jun. 13, 2002

Related U.S. Application Data

(63) Continuation-in-part of application No. 09/733,527, filed on Dec. 11, 2000, now Pat. No. 6,461,563.

(51) Int. Cl.[7] ..... B22F 7/06
(52) U.S. Cl. ..... 419/6; 419/36
(58) Field of Search ..... 419/6, 36

(56) References Cited

U.S. PATENT DOCUMENTS 4,602,952 A * 7/1986 Greene et al. ..... 75/228
4,602,956 A * 7/1986 Partlow et al. ..... 75/235
5,393,484 A * 2/1995 Seyama et al. ..... 419/37
5,541,006 A * 7/1996 Conley ..... 428/552
5,679,445 A * 10/1997 Massa et al. ..... 428/212
6,120,727 A * 9/2000 Asaka et al. ..... 419/6
6,461,563 B1 * 10/2002 Lim et al. ..... 419/5

FOREIGN PATENT DOCUMENTS

EP 0538073 A3 4/1993 ..... B22F/3/22
EP 0538073 A2 4/1993 ..... B22F/3/22

OTHER PUBLICATIONS

"MIM "Marries" Metals", Derived from a Paper Presented by Baumgartner et al., Under the Auspices of the European Powder Metal Association at the PM2001 Conference and Exhibition Held in Nice in Oct., *Technical Trends*, MPR Mar. 2002, pp. 38–42, www.metal–powder.net.
"Composite Parts by Powder Injection Molding," by Pest et al., BNSDOCID: XP–0011–7271, pp. 19–171 to 19–178.
"Composite Parts by Powder Injection Molding", Advances in Powder Metallurgy and Particulate Materials, vol. 5, pp. 19–171 to 19–178, 1996, by Andrea Pest et al.

* cited by examiner

*Primary Examiner*—Ngoclan Mai
(74) *Attorney, Agent, or Firm*—George O. Saile; Stephen B. Ackerman

(57) ABSTRACT

The invention shows how powder injection molding may be used to form a continuous body having multiple parts, each of which has different functional properties such as corrosion resistance or hardness, there being no connective materials such as solder or glue between the parts. This is accomplished through careful control of the relative shrinkage rates of these various parts. Although there is no limit to how many parts with different functional properties can make up an object, special attention is paid to certain pairs of functional properties that are difficult and/or expensive to combine in a single object when other manufacturing means are used.

6 Claims, 5 Drawing Sheets

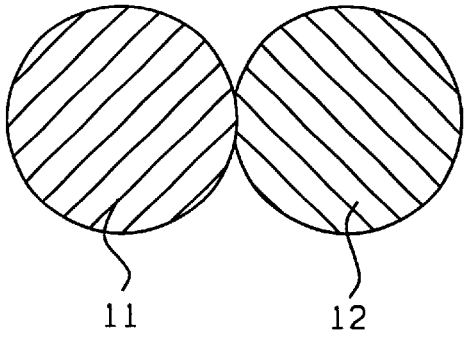
FIG. 1a – Prior Art
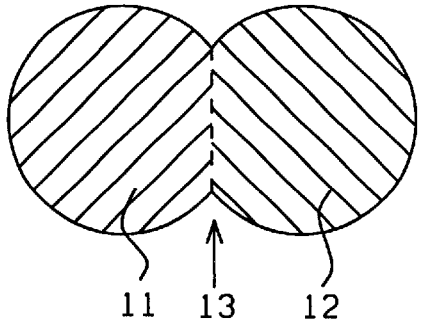
FIG. 1b – Prior Art
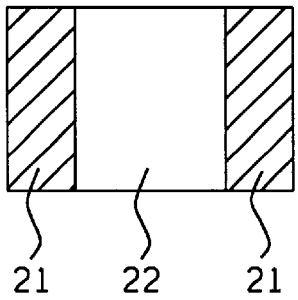
FIG. 2a
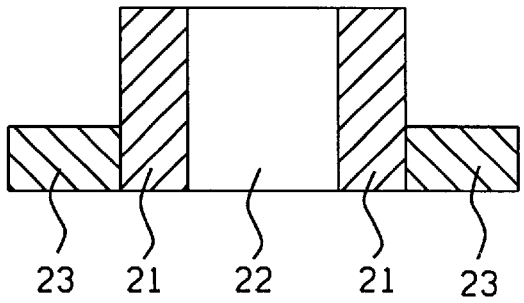
FIG. 2b

METHOD TO FORM MULTI-MATERIAL COMPONENTS

Continuation in part of application Ser. No. 09/733,527 which was filed Dec. 11, 2000 now U.S. Pat. No. 6,461, 563B1.

FIELD OF THE INVENTION

The invention relates to the general field of powder metallurgy and compression molding with particular reference to forming complex structures.

BACKGROUND OF THE INVENTION

The production of metal or ceramic components using powder injection molding (PIM) processes is well known. The powder is mixed with the binder to produce a mixture that can be molded into the desired part. The binder must have suitable flow properties to permit injection into a tooling cavity and forming of the part. The molded part is usually an oversized replica of the final part. It is subjected to debinding where the binder is removed without disturbing the powder orientation. After the binder is removed, the part is subjected to sintering process that results in part densification to a desired level.

The parts produced by PIM may be complex in geometry. They also tend to be made of a single material. For example, an orthodontic bracket can be made of 316L stainless steel using PIM technology.

There is, however, a need for objects, formed by PIM, that contain multiple parts, each of which is a different material whose properties differ from those of its immediate neighbors. The prior art practice has been to form each such part separately and to then combine them in the finished product using costly welding operations or mechanical fitting methods to bond these different parts of different materials together.

The basic approach that the present invention takes to solving this problem is schematically illustrated in FIGS. 1*a* and 1*b*. In FIG. 1*a*, 11 and 12 represent two green objects having different physical properties and formed by PIM. FIG. 1*b* shows the same two objects, after sintering, joined to form a single object. In the prior art, the interface 13 between 11 and 12 was usually a weld (i.e. a different material from either 11 or 12). Alternately, a simple press fit between the 11 and 12 might have sufficed so that the final object was not a continuous body.

An obvious improvement over welding or similar approaches would appear to have been to sinter 11 and 12 while they were in contact with one another. In practice, such an approach has usually not succeeded due to a failure of the two parts to properly bond during sintering. The present invention teaches how problems of this sort can be overcome so that different parts made of materials having different physical properties can be integrated to form a single continuous body.

A routine search of the prior art was performed with the following reference of interest being found: In "Composite parts by powder injection molding", Advances in powder metallurgy and particulate materials, vol. 5, pp 19–171 to 19-178, 1996, Andrea Pest et al. discuss the problems of sintering together parts that comprise more than one material. They show that control of shrinkage during sintering is important but other factors (to be discussed below) are not mentioned.

SUMMARY OF THE INVENTION

It has been an object of the present invention to provide a process for the formation of a continuous body having multiple parts, each with different physical properties and/or different functional properties, there being no connecting material (such as solder or glue) between any of the parts.

This object have been achieved by using powder injection molding together with careful control of the relative shrinkage rates of the various parts. Additionally, for the case where it is the physical properties that differ between parts, care is taken to ensure that only certain selected physical properties are allowed to differ between the parts while others may be altered through relatively small changes in the composition of the feedstocks used.

Another object has been to provide a process for forming, in a single integrated operation, an object that is contained within an enclosure while not being attached to said enclosure.

This object has been achieved by means of powder injection molding wherein the shrinkage rate of the object is caused to be substantially greater than that of the enclosure. As a result, after sintering, the object is found to have detached itself from the enclosure, being free to move around therein.

BRIEF DESCRIPTION OF THE DRAWINGS

FIGS. 1*a* and 1*b* illustrate two contiguous parts, made of different materials, before and after sintering, respectively.

FIGS. 2*a* and 2*b* show steps in the process of the present invention.

DESCRIPTION OF THE PREFERRED EMBODIMENTS

Figure 3:
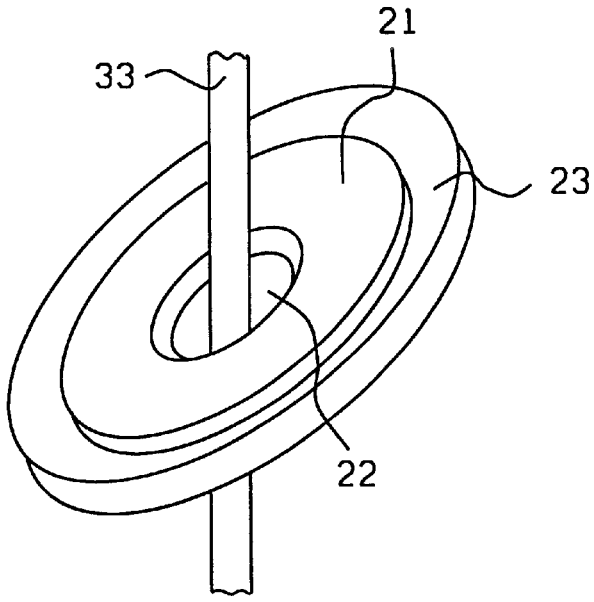
FIG. 3 is an isometric view of the object seen in cross-section in FIG. 2*b*.

This invention describes a novel method of manufacturing multi-material components using powder injection molding processes. Injection molding of different-material articles is an economically attractive method for manufacturing finished articles of commercial values due to its high production capacity and net shape capability.

As is well known to those skilled in the art, the basic procedure for forming sintered articles is to first provide the required material in powdered form. This powder is then mixed with lubricants and binders to form a feedstock. Essentially any organic material which will decompose under elevated temperatures without leaving an undesired residue that will be detrimental to the properties of the metal articles, can be used. Preferred materials are various organic polymers such as stearic acids, micropulvar wax, paraffin wax and polyethylene. Stearic acid serves as a lubricant while all the other materials may be used as binders. The amount and nature of the binder/lubricant that is added to the powder will determine the viscosity of the feedstock and the amount of shrinkage that will occur during sintering.

Once the feedstock has been prepared, it is injected into a suitable mold. The resulting 'green' object is then ejected from the mold. It has sufficient mechanical strength to retain its shape during handling while the binder is removed by heating or through use of a solvent. The resulting 'skeleton' is then placed in a sintering furnace and, typically, heated at a temperature between about 1,200 and 1,350° C. for between about 30 and 180 minutes in hydrogen or vacuum.

As already noted, attempts to form single objects containing parts made of different materials have usually been limited to forming the parts separately and joining them together later. This has been because green parts made of different materials could not be relied upon to always bond properly during the sintering process.

The present invention teaches that failure to bond during sintering comes about because (i) the shrinkage of the parts differs one from the other by more than a critical amount and (ii) certain physical properties differ between the parts.

By the same token, certain other physical properties may be quite different between the parts with little or no effect on bonding.

Physical properties that need to be the same or similar if good bonding is to occur include (but are not limited to) coefficient of thermal expansion and melting point, while properties that may differ without affecting bonding include (but are not limited to) electrical conductivity, magnetic coercivity, dielectric constant, thermal conductivity, Young's modulus, hardness, and reflectivity.

In cases that are well suited to the practice of the present invention it will not be necessary for the composition of two powders to vary one from another by very much. Typically, the two mixtures would differ in chemical composition by less than about 25 percent of all ingredients.

Additionally, it is important that the powders that were used to form the feedstocks of the two parts share similar characteristics such as particle shape, texture, and size distribution. The tap densities of the two powders should not differ by more than about 30% while the mean particle size for both powders should be in the range of about 1 to 40 microns.

As an example, if one part needs to be soft material (say low carbon iron), and another part is to be a hard material such as high carbon iron, then alloying the low carbon iron with specific amount of carbon will enhance hardenability and meet the requirement of high carbon iron. In so doing, both powders are still similar and have similar shrinkage rates. This will give rise to good bonding between the two materials while having different properties.

Similarly, if one material is low carbon iron and another is stainless steel, then blending the master alloy of the stainless steel with an appropriate amount of iron powder to form the required stainless steel composition can bring the overall powder characteristics closer to each other. For example, if two materials are 316L Stainless Steel and low carbon iron. Then the approach is to blend one third of master alloy of 316L with two-third of low carbon iron to form the actual 316L composition.

Note that molding of a two-material article can be achieved in one tooling of one or several cavities in a single barrel machine of one material first. The molded article is transferred to another tooling in another single barrel machine of another material to form the desired article though a manual pick-and-place operation or by using a robotic arm. The molding process can also be carried out on a twin-barrel injection machine to mold a complete article with two materials within a single tooling.

1st Embodiment

We will illustrate this embodiment through reference to FIGS. 2*a* and 2*b*, but it should be understood that the process that we disclose is independent of the shape, form, size, etc. of the structure that is formed.

The first step is the preparation of a first feedstock. This is accomplished by adding lubricants and binders (as discussed earlier) to a mixture of powders. The latter consist, by weight, of about 0.05 percent carbon, about 15 percent chromium, about 0.5 percent manganese, about 0.5 percent silicon, about 0.3 percent niobium, about 4 percent nickel, and about 80 percent iron. Using a suitable mold, this first feedstock is compression molded to form first green part 21, as shown in FIG. 2*a*. This happens to have a cylindrical shape with 22 representing the hollow center.

Then, a second feedstock is formed by adding lubricants and binders to a mixture of powders consisting, by weight, of about 0.05 percent carbon, about 15 percent chromium, about 0.5 percent manganese, about 0.5 percent silicon, about 0.3 percent niobium, about 14 percent nickel, and about 70 percent iron. It is important that the lubricants and binders are present in concentrations that ensure that, after sintering, the difference in the amounts the two feedstocks shrink is less than about 1% of total shrinkage experienced by either one.

We note here that although the two feedstocks have the same composition except that 10% of iron has been replaced by an additional 10% of nickel. This relatively small change in chemical composition leaves the key physical properties associated with successful sintering unchanged but introduces a significant change in the magnetic properties.

Next, first green part 21 is transferred to a second mold into which is then injected a sufficient quantity of the second feedstock to complete the structure shown in FIG. 2*b* through the placement of 23 around ring 21.

Once the final 'compound' green object has been formed, all lubricants/binders are removed, in ways discussed earlier, resulting in a powder skeleton which can then be sintered so that it becomes a continuous body having both magnetic and non-magnetic parts. Because of the compositions of the originals powders from which the two feedstocks were formed, part 21 of FIG. 2*b* that derived from the first feedstock is magnetic while part 23 that derived from the second feedstock is not. In this particular example the magnetic part has a maximum permeability ($\mu$ max) between about 800 and 1,500.

In FIG. 3 we show an isometric view of the object seen in FIG. 2*b* with the addition of rod 33 which is free to move back and forth through hole 22. If rod 33 is magnetic, its position relative to hole 22 could be controlled by means of an applied magnetic field generated by an external coil (not shown). Since part 21 is of a magnetic material, it will act as a core for concentrating this applied field. Rod 33 could be formed separately or it could be formed in situ as part of an integrated manufacturing process, using the method to be described later under the second embodiment.

Figure 4:
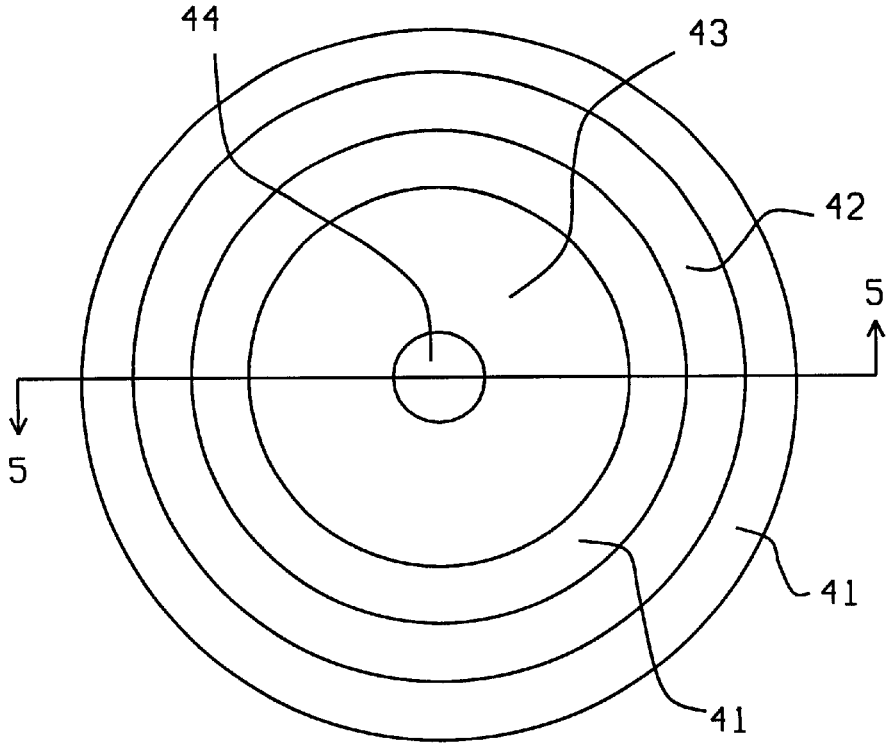
FIG. 4 is a plan view of an object that has three parts, one non-magnetic, one a hard magnet, and one a soft magnet.

As already implied, the formation of a continuous body having multiple parts, each with different properties, need not be limited to two such parts. In FIG. 4 we show a plan view of an object having three parts, each with different properties. All parts are concentric rings. At the center of the structure is opening 44 that is surrounded by inner ring 43. Ring 43 is non-magnetic. It is surrounded by ring 41 that is a soft magnet. Its inner portion has the same thickness as ring 43. Ring 41 also has an outer portion that is thicker than ring 43, causing it to have an inside sidewall 52 which can be seen in the cross-sectional view shown in FIG. 5. Aligned with, and touching, this sidewall is intermediate ring 42 which is a hard magnet. In this context, the term soft magnet refers to a material having a low coercivity with high magnetic saturation while the term hard magnet refers to a material having a high coercivity.

Figure 5:
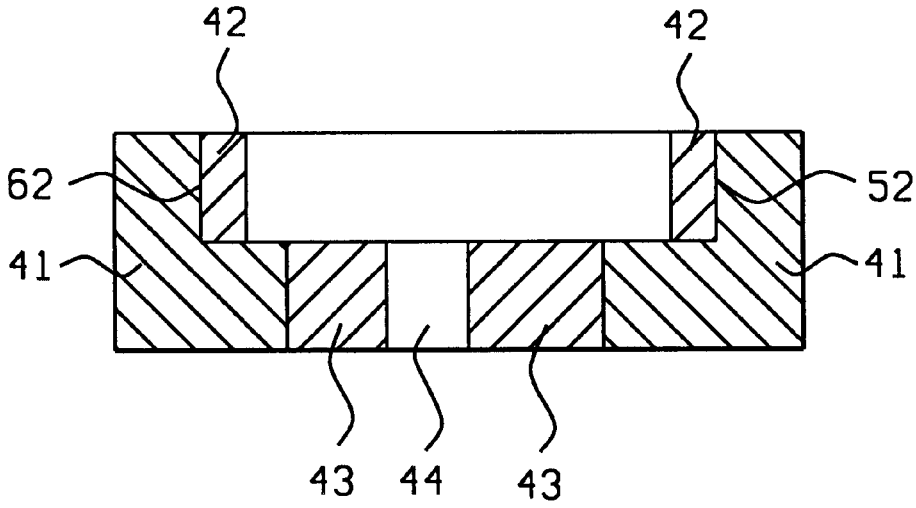
FIG. 5 is a cross-section taken through the center of FIG. 4.

The structure seen in FIGS. 4 and 5 is made by fitting hard magnet 42 (made separately) into the integral part after 41 and 43 have been formed. The reason for adding a ring of magnetically hard material to a structure that is similar to that seen in FIG. 3 is to be able to provide a permanent bias for the applied external magnetic field.

2nd Embodiment

In this embodiment we disclose a process for forming, in a single integrated operation, one object that is enclosed by another with the inner object not being attached to the outer object. As for the first embodiment, the process is illustrated through an example but it will be understood that it is applicable to any shaped object inside any shaped enclosure.

Figure 6:
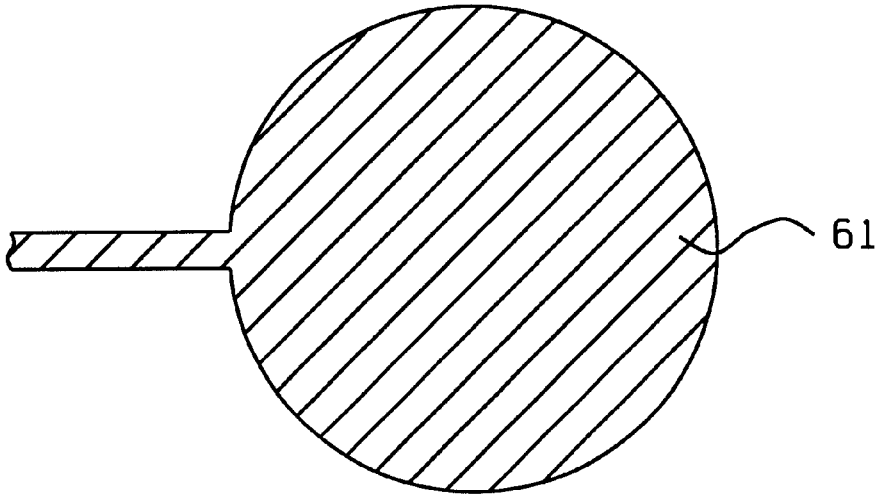
FIGS. 6 to 8 illustrate steps in the process of the second embodiment wherein an object is formed inside an enclosure.

In FIG. 6 we show, in schematic representation, an object that has been formed through PIM. As part of the process for its formation, the quantity and quality of the binders/lubricants were chosen so that, after sintering, the green form of 61 would shrink by a relatively large amount (typically between about 20 and 50%).

Figure 7:
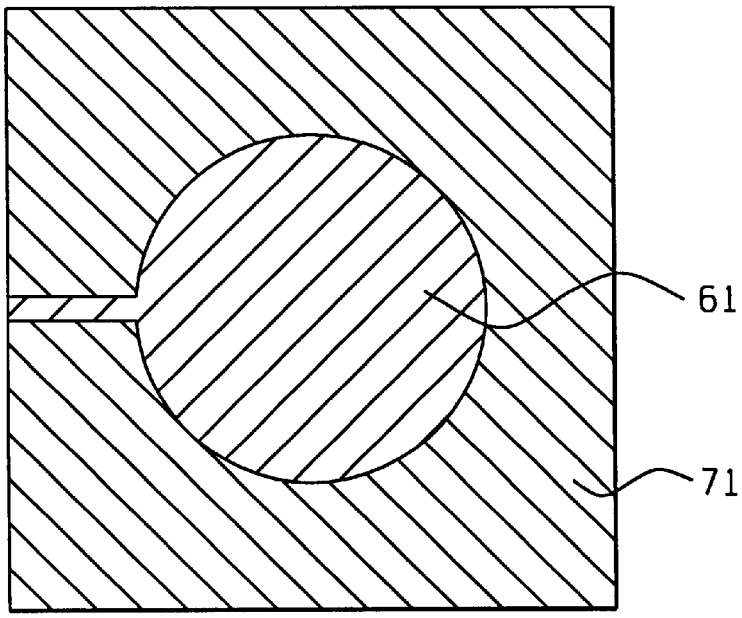

Referring now to FIG. 7 we show enclosure 71 that has been formed by fully surrounding 61 with material from a second feedstock for which binders/lubricants were chosen so that, after sintering, the green form of 71 would shrink by a relatively small amount (typically between about 10 and 20%). Regardless of the absolute shrinkages associated with parts 61 and 71, it is a key requirement of the process that the difference between the two shrinkage rates be at least 10%.

Figure 8:
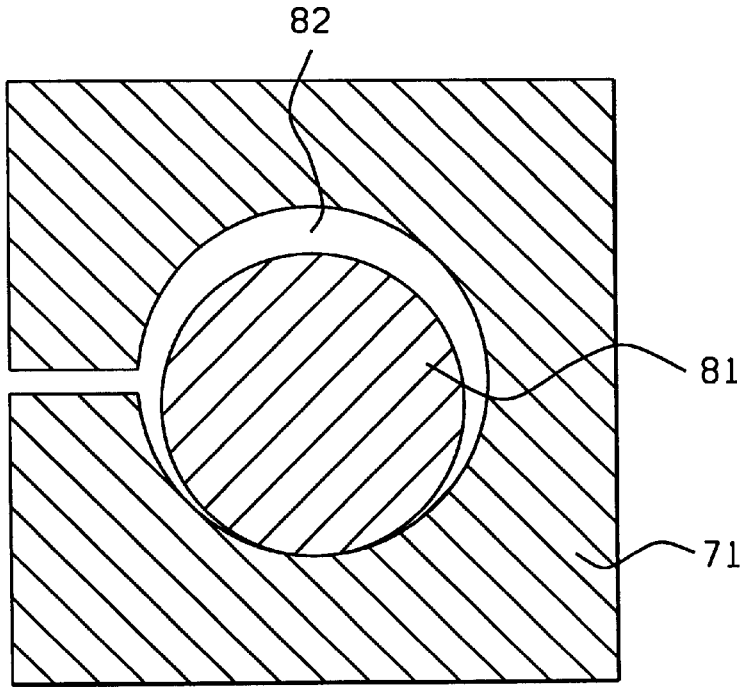

After the removal of all lubricants and binders from the object seen in FIG. 7, the resulting powder skeleton is sintered (between about 1,200 and 1,380° C. for between about 30 and 180 minutes in vacuum or in hydrogen for ferrous alloy steels. Because of the larger shrinkage rate of 61 relative to 71, the structure after sintering has the appearance shown in FIG. 8 where part 81 (originally 61) is seen to have become detached from 71 enabling it to move freely inside interior space 82. An example of a structure of this type is an electrostatic motor (unfinished at this stage) in which 71 will ultimately serve as the stator and 81 as the rotor. In the prior art, such structures had to be made using a sacrificial layer to effect the detachment of 81 from 71.

Functional Properties

In the foregoing discussion we were concerned with combining, in a single continuous structure, two or more parts that had different physical properties. The same principles that are taught there may also be applied to structures having two or more parts that differ in their functional properties. By functional properties we mean properties that are application related. Although functional properties derive from physical and chemical properties, they are often a subtle blend of the latter and the adjective used to describe them will depend on the application for which they are intended. Thus, a given electrical resistivity may be considered to be low when the application is for a resistor and high when the application is for a conductor. Functional properties are therefore harder to define but a definition must be provided for them to be meaningful.

We list below, as examples, a series of functional properties that are pertinent to the present invention, together with their definitions. It will be realized that this list is not complete and other functional properties could also be given to parts of a continuous structure without departing from the spirit of the invention. In most cases these definitions are precise but, occasionally, they must, of necessity, be of a descriptive rather than a quantitative nature:

- magnetic—ferromagnetic
- corrosion resistant—As defined in the ASTMG157-98 Standard Guide for Evaluating the Corrosion Properties of Wrought Iron and Nickel-Based Corrosion Resistant Alloys for the Chemical Process Industries. Examples of materials that have good corrosion resistance include (but not limited to) Pure Nickel, Nickel-Copper (eg Monel 400, Monel K-500), Nickel-Chromium (eg Inconel 617, Inconel 625) Nickel-Iron-Chromium (eg Incoloy DS, Incoloy 825), and Nickel-based superalloys (eg Nimonic 80A)
- controlled porosity—this manifests itself as a relative density, with a density 90–100% of the pore-free material being considered High and densities of 50–90% being considered Low
- high thermal conductivity—greater than about 100 W/m. K
- high density—greater than about 9,000 kg/m$^3$
- high strength—tensile greater than about 900 Mpa, yield greater than about 700 MPa.
- low thermal expansion—less than about $12\times10^{-6}$ K$^{-1}$
- wear resistant—having a hardness value less than about 50 HRC
- high elastic modulus—greater than 200 GPa
- high damping capacity—loss of 25% or more of stored energy per cycle
- good machinability—using AISI 1212 as a guide, steel is rated 100% with a value in excess of 50% being considered good
- highly fatigue resistant—able to withstand at least $10^8$ cycles of alternating standard and zero loads
- high hardness—greater than 50 HRC
- high toughness—Based on Charpy or Izod testing, toughness is defined as the energy per unit volume that can be absorbed by a material up to the point of fracture. High toughness implies a value greater than about $1\times10^5$ KJ/m$^3$
- high melting point—greater than about 1600° C. (iron melts at 1537° C.).
- oxidation resistant—as for corrosion resistant above, but limited to oxygen as the corrosive agent
- easy joinability—based on experience but includes materials such as copper, silver, and gold.

It follows from our earlier discussion of processes for forming continuous bodies having multiple parts, each of which has a different set of physical properties, that these same processes may be adapted to forming continuous bodies having multiple parts, each of which has a different set of functional properties. While in the general case these bodies will comprise more than two functional parts, we take note here of a special case in which only two functionally different parts are involved, said two different functions being particularly difficult and/or expensive to combine in a single continuous body when processes of the prior art are used for their manufacture.

The following lists some examples of functional pairs of this type, it being understood that other functional pairs could be added to this list without departing from the spirit of the invention:

magnetic-corrosion resistant, controlled porosity-high thermal conductivity, high density-high strength, high thermal conductivity-low thermal expansion, wear resistant-high toughness, controlled porosity-high strength, high elastic modulus-high damping capacity, high strength-good machinability, controlled porosity-highly fatigue resistant, magnetic-non-magnetic, high hardness-high toughness, wear resistant-oxidation resistant, easy joinability-corrosion resistant, and low internal stress-controlled porosity.

To further illustrate the application of the present invention to the manufacture of structures having two parts that would ordinarily be difficult to combine in a single continuous structure, we now describe two additional embodiments of the present invention.

3rd Embodiment

In this embodiment we disclose a process and structure for forming a cutting tool. As in the first and second embodiments, the process of the third embodiment begins with the provision of two mixtures of powdered materials. One the these mixtures will, after sintering, be well suited for use as a handle while the other, also after sintering, will have excellent properties for use as a cutting edge.

The mixture that is intended to become the handle is selected from materials such as iron, and all iron-based alloys (such as carbon steels, low-alloyed steels and stainless steels). See, for example, Metals Handbook, Volume 1, 10th edition 1990.

Possible materials for the mixture that will become the cutting edge are all tool steels, including water-hardening steels (Type W), shock-resisting steels (Type S), cold-work steels (Type O, A, D and H), hot-work steels (Type H), High speed steels (Type T and M), mold steels (Type P) and tungsten carbide. Details on the classification of tool steels may be found in in the AISI (American Iron and Steel Institute) handbook.

Figure 9:
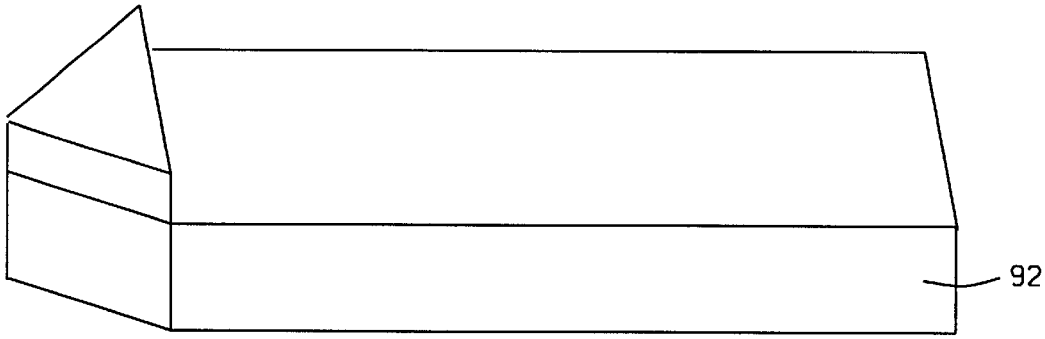
FIG. 9 shows a cutting tool formed through application of the present invention.

Lubricants and binders are added to each mixture to form feedstocks, a key requirement being that the amount that said feedstocks will shrink after sintering differs one from the other by less than about 1%. Then, the appropriate feedstock is compression molded to form a green part having the shape of a handle (shown schematically as 92 in FIG. 9) which is then transferred to a second mold into which is injected a sufficient quantity of the other feedstock for forming an extension to the green part in the shape of a cutting edge (shown schematically as 91 in FIG. 9).

After removal of all lubricants and binders (thereby forming a powder skeleton), the latter is sintered, as discussed earlier, to become the cutting tool.

4th Embodiment

In this embodiment we disclose a process and structure for forming a wire die. As in the previous embodiments, the process of the fourth embodiment begins with the provision of two mixtures of powdered materials. One the these mixtures will, after sintering, be well suited for use as a handle and is selected from the group consisting of iron, and all iron-based alloys (such as carbon steels, low-alloyed steels and stainless steels) while the other will be well suited to serve as a die, being selected from the group consisting of all tool steels, including water-hardening steels (Type W), shock-resisting steels (Type S), cold-work steels (Type O, A, D and H), hot-work steels (Type H), High speed steels (Type T and M), mold steels (Type P), and tungsten carbide.

Also as before, lubricants and binders are added to these mixtures to form feedstocks which, after sintering, will shrink by amounts that differ one from one another by less than about 1%.

Additionally, a third feedstock is provided that has the key property that, after sintering, it will shrink an amount that exceeds the amount that the first two feedstocks shrink by at least 10%. In this case the feedstock can be made from just binders, including waxes such as paraffin wax and thermoplastics such as polyethylene.

Figure 10:
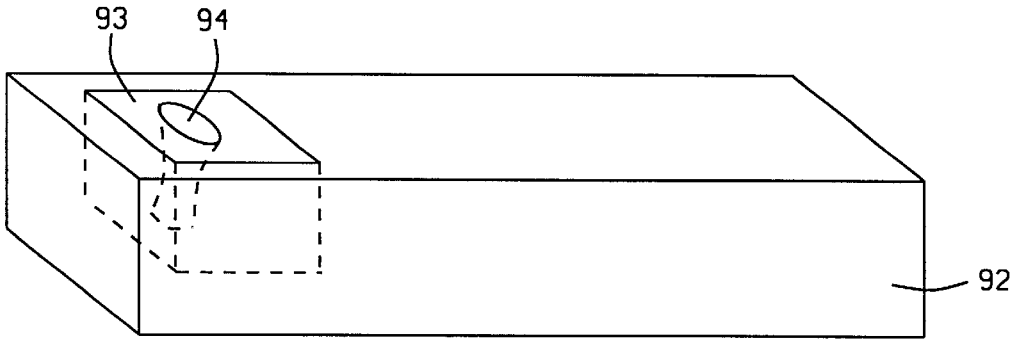
FIG. 10 shows a wire die formed through application of the present invention.

The appropriate feedstock is then compression molded to form a green part having the shape of a handle (see 92 in FIG. 10), following which it is transferred to a second mold into which is injected a sufficient quantity of the third feedstock to add to the green part an extension having a cylindrical pin-cushion shape (see 94 in FIG. 10). This modified green part is then transferred to a third mold into which is injected a sufficient quantity of the last feedstock to surround the pin-cushion shaped extension (see 93 in FIG. 10).

All lubricants and binders are then removed so that the green part becomes a powder skeleton which can be sintered to become a solid continuous material. After sintering, the residue of materials that were originally part of the third feedstock can be removed by mechanical and/or chemical means, resulting in formation of the die cavity (shown schematically as 94 in FIG. 10).

While the invention has been particularly shown and described with reference to the preferred embodiments thereof, it will be understood by those skilled in the art that various changes in form and details may be made without departing from the spirit and scope of the invention.

What is claimed is:

1. A process for manufacturing a compound sintered article, comprising the sequential steps of:

(a) providing a group of mixtures of powdered materials, each member of said group having, after sintering, a functional property that is different from any functional property possessed, after sintering, by any other member of the group;

(b) adding lubricants and binders to all members of said mixtures group, thereby forming a group of feedstocks, all of whose members shrink, after sintering, by amounts that differ from one another by less than about 1%;

(c) in a mold, compression molding a feedstock from said feedstock group, to form a green part;

(d) transferring said green part to a different mold and then injecting into said different mold a quantity of a different feedstock, taken from said feedstock group;

(e) repeating steps (c) and (d), each time using a different mold and a different feedstock, until all members of said feedstock group have been molded, thereby forming a final compound green part;

(f) removing all lubricants and binders from the final compound green part to form a powder skeleton; and (g) sintering the powder skeleton to form said compound sintered article.

2. The process described in claim 1 wherein said first and second functional properties are selected from the group consisting of magnetic, corrosion resistant, controlled porosity, high thermal conductivity, high density, high strength, low thermal expansion, wear resistant, high elastic modulus, high damping capacity, good machinability, fatigue resistance, high hardness, high toughness, high melting point, oxidation resistant, easy joinability, and low internal stress.

3. A process for manufacturing a compound sintered article, comprising:

providing a first mixture of powdered materials, said mixture having, after sintering, a first functional property;

providing a second mixture of powdered materials, said mixture having, after sintering, a second functional property;

adding lubricants and binders to said first and second mixtures to form first and second feedstocks such that the amount that said feedstocks will shrink after sintering differs one from the other by less than about 1%;

using a first mold, compression molding the first feedstock to form a first green part;

transferring said first green part to a second mold and then injecting into said second mold a quantity of the second feedstock sufficient to form a compound green part;

removing all lubricants and binders from the compound green part to form a powder skeleton; and sintering the powder skeleton to form said compound sintered article, whereby said first and second functional properties constitute a pair of functional properties selected from the group of functional property pairs consisting of magnetic-corrosion resistant, controlled porosity-high thermal conductivity, high density-high strength, high thermal conductivity-low thermal expansion, wear resistant-high toughness, controlled porosity-high strength, high elastic modulus-high damping capacity, high strength-good machinability, controlled porosity-fatigue resistant, magnetic-non-magnetic, high hardness-high toughness, wear resistant-oxidation resistant, easy joinability-corrosion resistant, and low internal stress-controlled porosity.

4. A process for manufacturing a cutting tool, comprising:

providing a first mixture of powdered materials, said mixture being, after sintering, suitable for use as a handle;

providing a second mixture of powdered materials, said mixture being, after sintering, suitable for serving as a cutting edge;

adding lubricants and binders to said first and second mixtures to form first and second feedstocks such that the amount that said feedstocks will shrink after sintering differs one from the other by less than about 1%;

using a first mold, compression molding the first feedstock to form a first green part having the shape of a handle;

transferring said first green part to a second mold and then injecting into said second mold a quantity of the second feedstock having the shape of a cutting edge, thereby forming, together with the first green part, a second green part;

removing all lubricants and binders from the second green part to form a powder skeleton; and sintering the powder skeleton thereby forming the cutting tool.

5. The process described in claim 4 wherein said first mixture of powdered materials is selected from the group consisting of iron, all iron-based alloys, carbon steels, low-alloyed steels, and stainless steels).

6. The process described in claim 4 wherein said second mixture of powdered materials is selected from the group consisting of all tool steels, water-hardening steels (Type W), shock-resisting steels (Type S), cold-work steels (Type O, A, D and H), hot-work steels (Type H), High speed steels (Type T and M), mold steels (Type P), and tungsten carbide.

* * * * *